United States Patent [19]

Sayer et al.

[11] Patent Number: 4,521,991

[45] Date of Patent: Jun. 11, 1985

[54] WINDOW APPARATUS

[75] Inventors: Bertram Sayer, Princeton; Bernard J. Kulkaski, Somerset, both of N.J.

[73] Assignee: Thermal Profiles, Inc., Plainview, N.Y.

[21] Appl. No.: 574,276

[22] Filed: Jan. 26, 1984

[51] Int. Cl.[3] ..... E05D 15/22

[52] U.S. Cl. ..... 49/161; 49/176

[58] Field of Search ..... 49/161, 176, 172, 184, 49/183

[56] References Cited

U.S. PATENT DOCUMENTS

| | | | |
|---|---|---|---|
| 1,474,521 | 11/1923 | Folgert | 49/184 |
| 3,080,950 | 3/1963 | Greene | 49/176 X |
| 3,335,523 | 8/1967 | Isler et al. | 49/176 X |
| 3,473,263 | 10/1969 | Osten, Sr. | 49/161 |
| 4,356,667 | 11/1982 | Malachowski | 49/161 X |

*Primary Examiner*—Philip C. Kannan

*Attorney, Agent, or Firm*—Bernard Malina

[57] ABSTRACT

A window apparatus includes a jamb assembly and a pair of window frame assemblies which are capable of sliding relative to the jamb assembly for the purpose of opening and closing and also tilting inwardly to facilitate cleaning. Locking members are provided on the upper corners of each of the window frames. The locking members are lodged in slots formed in the window frames and project beyond the window frames to engage the jamb assembly and prevent tilting of the window frames. The locking members have a relatively low level of stress when the window apparatus is subjected to wind loads, thereby enabling the window apparatus to withstand relatively high wind loads encountered on the upper floors of large buildings.

11 Claims, 7 Drawing Figures

FIG. 1
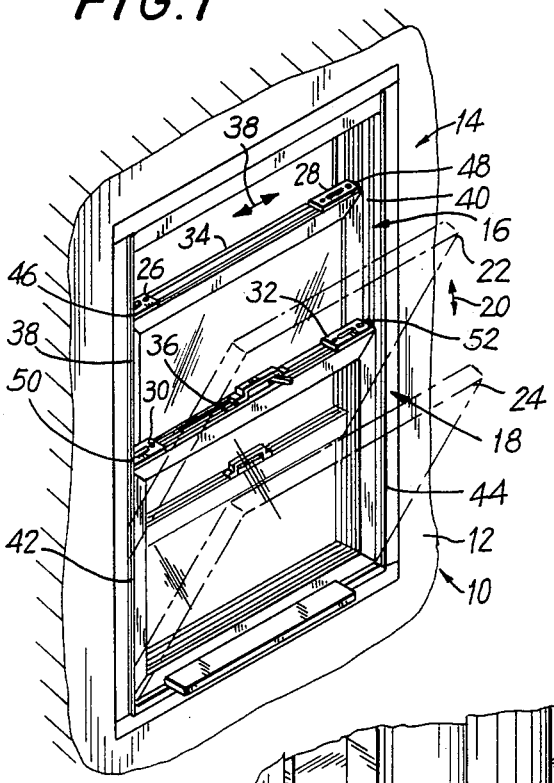
FIG. 2
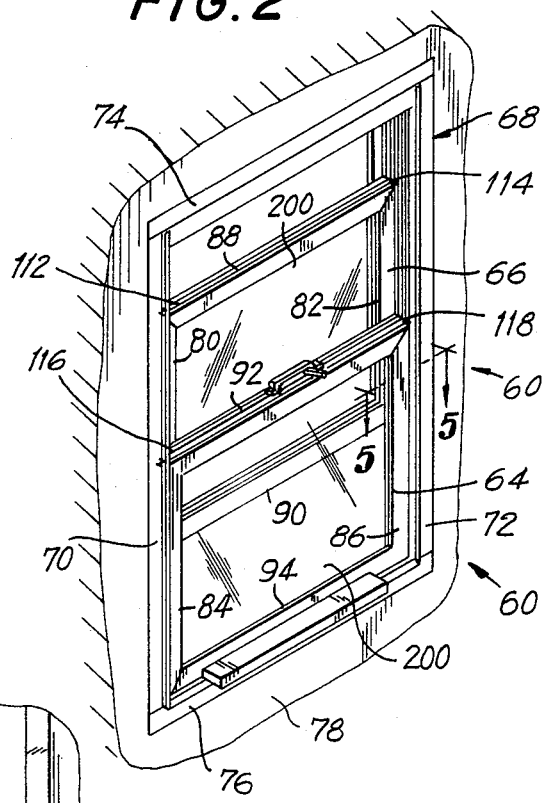
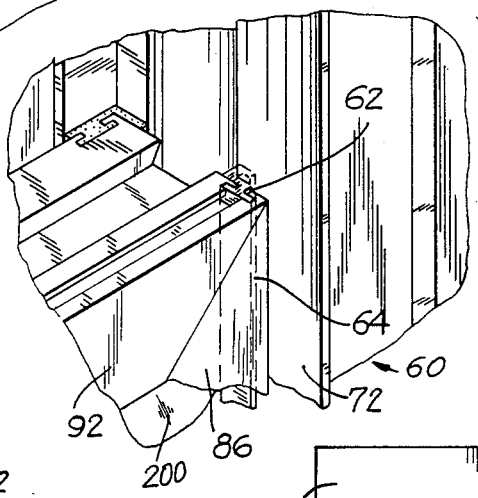
FIG. 2A
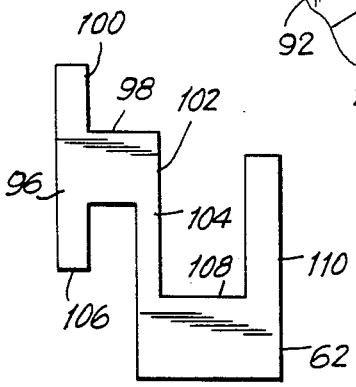
FIG. 3
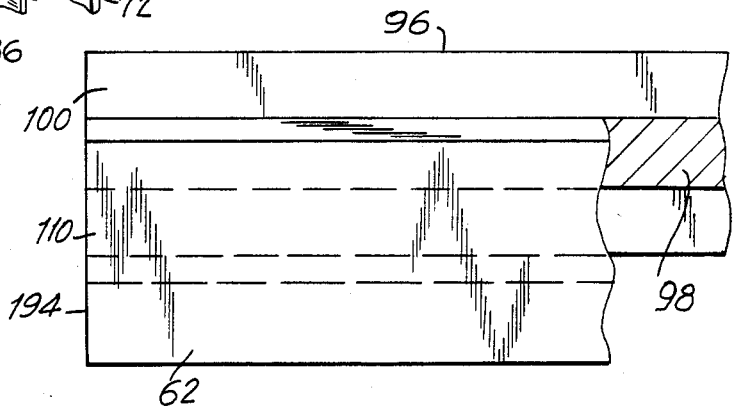
FIG. 4

WINDOW APPARATUS

BACKGROUND OF THE INVENTION

The prior art related to window apparatus includes a type of window which is conventionally known as a double-hung window. This type of window includes a frame or jamb assembly, which is attached to the wall of a building, and usually two window frames or sashes which are mounted on the jamb assembly and which slide in a vertical direction relative to the jamb assembly. The window frames support panes of glass or plastic glazing material. An important type of double-hung window includes provisions for tilting the individual window frames inwardly for the purpose of cleaning.

Although the tilting type of double-hung window has found extensive application in private homes and other relatively small buildings, the application of this type of window to large office and apartment buildings has not been practical because of the inability of such windows to withstand the wind loading normally encountered by such buildings.

Another disadvantage of the conventional tilting type of double-hung window is that this type of window provides only limited security against forced entry by a person who pushes against the window frames in a direction which causes them to tilt and by doing so overcomes the relatively weak anti-tilt locks usually provided on such windows.

OBJECTS OF THE INVENTION

It is an object of the present invention to provide a tilting type of double-hung window which is capable of withstanding high wind loads present on the upper floors of large offices or apartment houses.

Another object of the present invention is to provide a window apparatus which is capable of being easily and securely locked against tilting.

Another object of the present invention is to provide a tilting type of window apparatus which can be reversibly locked against tilting.

Still another object of the present invention is to provide a window apparatus which includes an anti-tilting locking member which can be manufactured at a relatively low unit cost.

SUMMARY OF THE INVENTION

In accordance with the present invention there is provided a window apparatus which includes a jamb assembly and a pair of window frame assemblies or sashes. The window frame assemblies are mounted on the jamb assembly in a manner which permits the window frame assemblies to slide with respect to the jamb assembly to open and close the window and also to tilt inwardly to facilitate cleaning. A pair of locking members are mounted on the upper portions of each of the window frames for the purpose of preventing unwanted tilting of the window frames when the window assembly is installed in a large building. The locking members each comprise an elongated member which engages and is retained by a slotted portion which is formed in the window frames. The locking members also have a projecting portion which engages a lip portion formed on the jamb assembly and thereby prevents tilting of the window frame assemblies.

BRIEF DESCRIPTION OF THE DRAWINGS

Additional objects and advantages of the invention will become apparent during the course of the following specification, when taken in connection with the drawings, in which:

FIG. 1 is a perspective view of a conventional double-hung tilting window apparatus with the tilted position of the upper and lower window frames shown in broken lines;

FIG. 2 is a perspective view of a window apparatus according to the present invention;

FIG. 2A is a fragmentary perspective view of a portion of the window apparatus of FIG. 2, with FIG. 2A being drawn to an enlarged scale;

FIG. 3 is an end view of a locking member according to the present invention;

FIG. 4 is a side view, partially in section, of the locking member of FIG. 3;

DETAILED DESCRIPTION OF THE INVENTION

Figure 5:
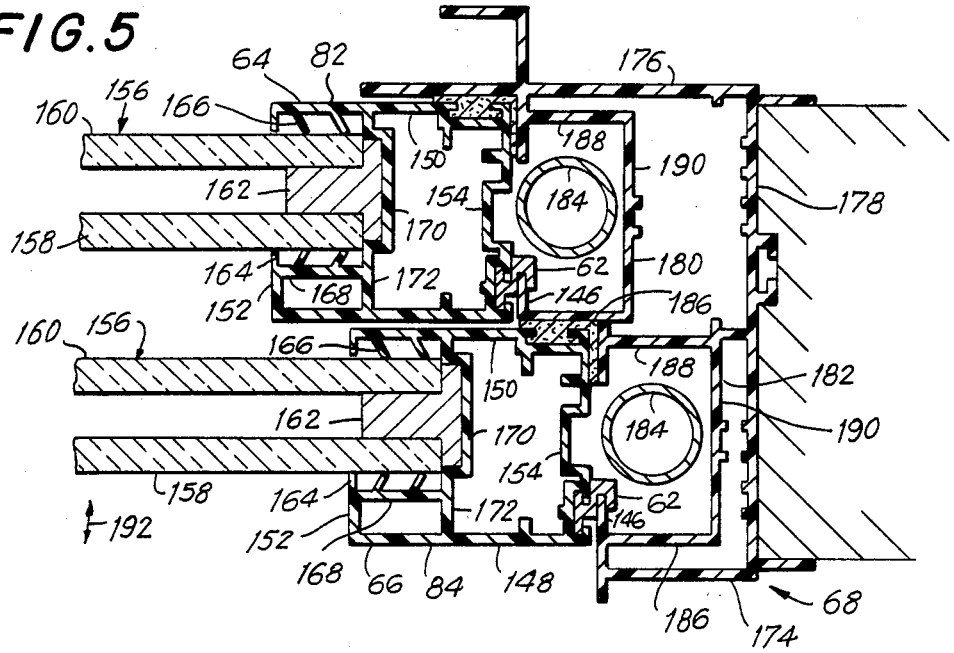
FIG. 5 is a cross-sectional view taken along the line 5—5 of FIG. 2 showing locking members installed between the upper frame assembly and the jamb assembly and between the lower frame assembly and the jamb assembly.

With reference to the drawings, there is shown in FIG. 1 a conventional tilting type of double-hung window apparatus 10. The window apparatus 10 is mounted on the wall 12 of a building and comprises a jamb assembly 14 and a pair of window frame or sash assemblies 16, 18 each of which is disposed to slide in a vertical direction relative to the jamb assembly 14, as indicated by the arrow 20 in FIG. 1. The window frames 16, 18 are also capable of pivoting inwardly as indicated by the broken lines 22 and 24. In the conventional window apparatus 10, the window frames 16, 18 each may be locked against tilting by means of a pair of slide locks 26, 28, 30, 32 which are mounted on the upper portions 34, 36 of the window frames 16, 18.

The slide locks 26, 28, 30, 32 slide in the directions shown by the arrows 38 to project beyond the vertical edges 38, 40, 42, 44 of the window frames 16, 18 and engage the jamb assembly 14 thereby preventing tilting of the window frames 16, 18. The slide locks 26, 28, 30, 32 each engage the jamb assembly 14 at a single point of contact 46, 48, 50, 52 and therefore provide only a limited capability for withstanding high wind loadings or forced entry. A wind load applied to the conventional window apparatus 10 causes the window frames 16, 18 to tilt and therefore causes a concentrated load to occur on the slide locks 26, 28, 30, 32 and on the jamb assembly 14 at the points 46, 48, 50, 52 where the slide locks 26, 28, 30, 32 engage the jamb assembly.

A high wind load can cause a mechanical failure of the slide locks 26, 28, 30, 32 and also a failure of the jamb assembly 14. The danger of this type of mechanical failure is especially severe for a broad class of window apparatus in which the window frames 16, 18 and the jamb assembly 14 are fabricated of hollow, extruded plastic sections. This type of construction is strong enough for normal wind loads which may be encountered by window installations in relatively small buildings but this type of construction can not withstand the concentrated loading imposed by high wind loads encountered by window installations in relatively tall buildings.

FIGS. 2 and 2A show a window apparatus 60 according to the present invention which incorporates four identical locking members 62 which lock the window frames 64, 66 against tilting with respect to the jamb assembly 68. The jamb assembly 68 comprises a frame formed by a pair of vertical members 70, 72 and a pair of horizontal members 74, 76. The jamb assembly 68 is set into the wall 78 of a building in a manner similar to that of the conventional window apparatus 10. The window frame assemblies 64, 66 each include a pair of vertical members or stiles 80, 82, 84, 86 and a pair of horizontal members or rails 88, 90, 92, 94, and the window frame assemblies 64, 66 each support a pane of glass 200 or plastic glazing materials.

Figure 6:
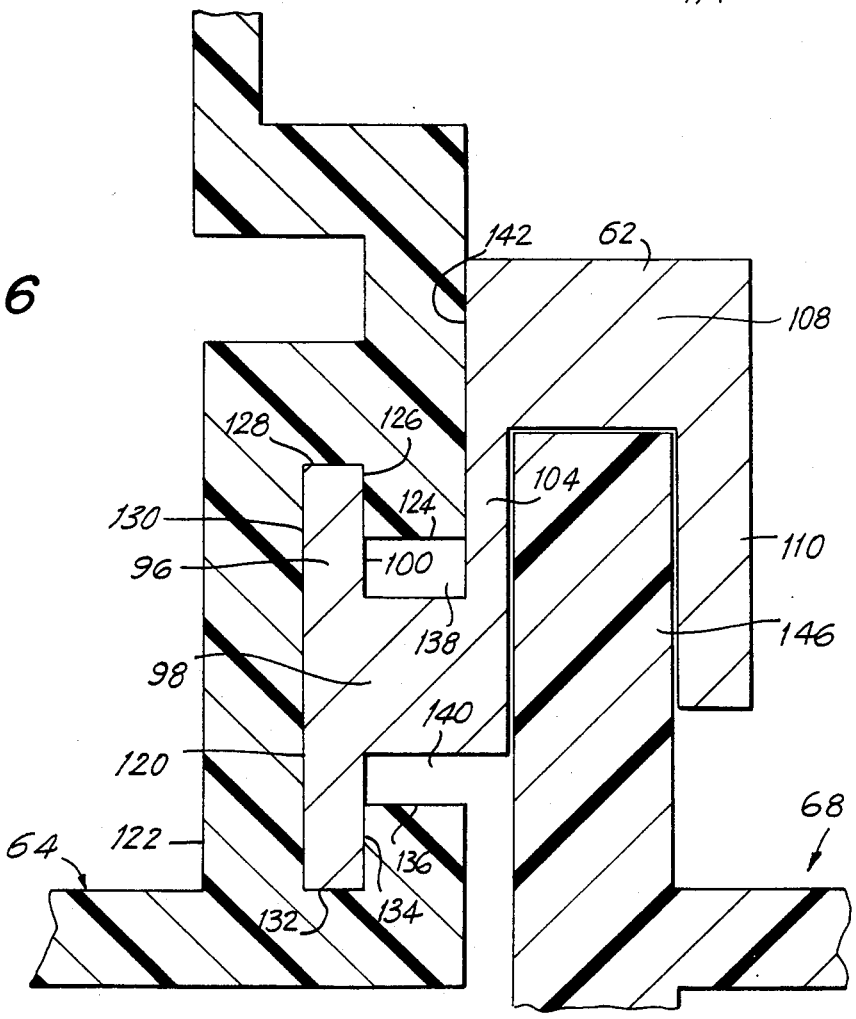
FIG. 6 is a fragmentary cross-sectional view, similar to FIG. 5 with FIG. 6 being drawn to an enlarged scale.

The locking members 62 are mounted on the upper portions of the window frame assemblies 64, 66 in the manner which is best shown in FIG. 2A and FIG. 6. The details of construction of the locking members 62 are best shown in FIGS. 3 and 4. As is shown in FIG. 3, the locking member 62 includes a base portion 96 which is generally rectangular in cross-section. A projecting portion 98 projects from the surface 100 of the base portion 96. The end 102 of the projecting portion 98 is connected to a first arm portion 104 which is generally parallel to the surface 100 of the base portion 96 and which projects toward the end 106 of the base portion 96. The first arm portion 104 is connected to a spacer portion 108 which is generally perpendicular to the first arm portion 104. The spacer portion 108 is connected to a second arm portion 110 which is generally parallel to the first arm portion 104.

FIGS. 2A, 5 and 6 show in detail the engagement between the locking member 62, the window frame 64, and the jamb assembly 68. The details of construction shown in FIGS. 2A, 5 and 6 are typical for the locations indicated by the numerals 112, 114, 116, 118 in FIG. 2. The base portion 96 of locking member 62 is inserted in a slot 120 formed in the outer wall 122 of the window frame 64. The slot 120 in the window frame is defined by the surfaces 124, 126, 128, 130, 132, 134, 136 shown in FIG. 6. The projecting portion 98 of the locking member 62 projects outwardly toward the jamb assembly 68. The surfaces 126, 128, 130, 132, 134 are proportioned to closely fit the dimensions of the locking member 62.

The surfaces 124, 136 are disposed to provide slight spaces 138, 140 between the projecting portion 98 and the window frame assembly 64. The first arm portion 104 of the locking member 62 is disposed between the surface 142 of the window frame assembly and the jamb assembly 68. The spacer portion 108 and the second arm portion 110 of the locking member 62 engage a lip 146 formed on the jamb assembly 68. The slight spaces 138, 140 between the window frame and the projecting portion 98 of the locking member 62 accommodates any buildup of manufacturing tolerances.

FIG. 5 shows details of construction of the window apparatus 60 and shows the installation of the locking members 62 on the upper and lower window frames 64, 66. The upper and lower window frames 64, 66 are identical in construction and in the following description, corresponding portions of the upper and lower window frames 64, 66 will have the same reference numbers. The vertical members, or stiles 82, 84, each comprise a hollow member which includes a front wall 148, a rear wall 150, an inner wall 152 and an outer wall 154. The glazing material 156 comprises two individual sheets 158, 160 which are connected by a spacer member 162. The glazing material 156 is inserted into an aperture 164 formed in the inner wall 152 and is retained by fin members 166 formed on the rear wall 150 and on an intermediate wall 168. The glazing material 156 is also retained by a channel 170 formed on a connecting wall 172 which connects the front and rear walls 148, 150.

The jamb assembly 68 has a front wall 174, a rear wall 176, a side wall 178, and a pair of balance channels 180, 182 which are disposed between the front and rear walls. The balance channels 180, 182 each contain a sash balance 184 which aids in opening the window frames 64, 66. The balance channels 180, 182 each include a front wall 186, a rear wall 188, and a side wall 190. The balance channels 180, 182 also include the lip portion 146 which is connected to the side wall 190.

In the preferred embodiment, the upper and lower window frames 64, 66 and the jamb assembly 68 are each fabricated of hollow, extruded plastic members.

As is shown in FIG. 4, the locking member 62 is an elongated member. The relatively long length of this member results in a relatively large contact area and a low unit stress on the surfaces 126, 128, 130, 132, 134 of the window frames 64, 66 and on the lip 146 even when the window apparatus 60 is subjected to wind loads which are typically perpendicular to the plane of the glazing material 156 as indicated by the arrow 192 in FIG. 5. The locking member 62 may be fabricated as an extrusion either of metal or plastic.

In the preferred embodiment of the invention, the locking member 62 is inserted into the slot 120 so that the top 194 of the locking member 62 is flush with the top of the window frame rail 92 as is shown in FIG. 2A. This mode of installation makes it relatively difficult for an unauthorized user to remove the locking member 62, thereby contributing to the overall security of the apparatus 60.

In an alternative embodiment of the invention, which is not shown, a tab may be formed on the top 194 of the locking member 62 and the tab may be left to project above the window frame rail 92 when the locking member is installed, thereby facilitating removal of the locking member.

The ability of the window apparatus 60, according to the present invention, to withstand the forces imposed by high wind loads has been demonstrated during a series of structural tests performed on a sample window by an independent test laboratory, Architectural Testing Inc. of York, Pa.

The following is a general description of the construction of the test window and the structural testing performed:

MODEL: Thermalator DH-300

TYPE : Poly Vinyl Chloride (PVC) Double Hung Prime Window

OVERALL SIZE: 4'-0" wide by 6'-0" high

TOP SASH SIZE: 3'-9½" wide by 2'-11 1/16" high

BOTTOM SASH SIZE: 3'-8½" wide by 2'-11 1/16" high

GLAZING: ⅞" thick insulating glass fabricated from two ⅛" thick sheets and a metal spacer, channel glazed into dual durometer PVC sash members consisting of a rigid PVC shape with 6 soft vinyl fins in each sash member channel LOCKS: four Thermalator tilt keys (locking members) located one each, on the top corners of each sash stile.

The test specimen was evaluated for conformance to the following industry specifications: ASTM D 4099-82 "Standard Specification for PVC Prime Windows" and the primary performance requirements of ANSI/AAMA 302.9-1977 for DH-A2.5 HP Windows. The results of the structural tests are summarized below:

| Title of Test | Test Result (deflection) | Allowable Limit (deflection) |
|---|---|---|
| Uniform Load Deflection | | |
| at 10 pounds per square foot exterior | 0.164" | 0.247" |
| Uniform Load Structural | | |
| at 30 pounds per square foot exterior | 0.032" | 0.180" |
| at 15 pounds per square foot interior | 0.014" | 0.180" |
| at 75 pounds per square foot exterior | 0.079" | 0.180" |
| at 75 pounds per square foot interior | 0.101" | 0.180" |
| Deglazing Force | | |
| at 70 pounds in operating direction | | |
| Bottom sash pull rail | 0.101" | 0.625" |
| Bottom sash meeting rail | 0.094" | 0.625" |
| Top sash meeting rail | 0.031" | 0.625" |
| Top sash pull rail | 0.028" | 0.625" |
| at 50 pounds in remaining direction | | |
| Bottom sash stile | 0.038" | 0.625" |
| Bottom sash stile | 0.028" | 0.625" |
| Top sash stile | 0.019" | 0.625" |
| Top sash stile | 0.021" | 0.625" |

The test window successfully met the performance specification requirements for a grade 60 window as set forth in Table 1 of ASTM Specification D 4099-82.

While a preferred embodiment of the invention has been shown and described herein, it is obvious that numerous additions, changes and omissions may be made in such embodiments without departing from the spirit and scope of the invention.

What is claimed is:

1. A window apparatus comprising window jamb means, window frame means mounted on said jamb means and capable of sliding relative to said jamb means from a closed position to an open position and capable of pivoting with respect to said window jamb means and removable locking member means engaging both said window frame means and said window jamb means to prevent said pivoting of said window frame means, said window jamb means including a lip portion perpendicular to plane of window with said locking member means engaging said lip portion.

2. A window apparatus according to claim 1 in which said window frame means includes a portion located proximate to said window jamb means with said portion defining a slot and with said locking member means engaging said slot.

3. A window apparatus according to claim 2 in which said locking member means comprises a base portion removeably disposed in said slot and a projecting portion disposed to project outwardly relative to said window frame means for the purpose of engaging said window jamb means.

4. A window apparatus according to claim 3 in which said locking member further comprises a pair of spaced apart arm portions mounted on said projecting portion with said arm portions engaging said window jamb means.

5. A window apparatus according to claim 1 in which said window frame is generally rectangular.

6. A window apparatus according to claim 1 in which said locking member means comprises a pair of locking members mounted, one each, on opposing edges of said window frame means.

7. A window apparatus according to claim 1 in which said window jamb means is made of plastic.

8. A window apparatus according to claim 1 in which said window frame means is made of plastic.

9. A window apparatus according to claim 1 in which said locking means is made of plastic.

10. A window apparatus according to claim 1 in which said locking means is made of metal.

11. A window apparatus according to claim 1 in which said locking means comprises an elongated member.

* * * * *